US006315146B1

(12) United States Patent
Johnsen

(10) Patent No.: US 6,315,146 B1
(45) Date of Patent: Nov. 13, 2001

(54) CLOSURE FOR CONTAINERS AND USE OF THE CLOSURE

(75) Inventor: Tove Drejer Johnsen, Tarm (DK)

(73) Assignee: Lid Systems A/S (DK)

( * ) Notice: Subject to any disclaimer, the term of this patent is extended or adjusted under 35 U.S.C. 154(b) by 0 days.

(21) Appl. No.: 09/485,425

(22) PCT Filed: Aug. 6, 1998

(86) PCT No.: PCT/DK98/00341

§ 371 Date: May 8, 2000

§ 102(e) Date: May 8, 2000

(87) PCT Pub. No.: WO99/07613

PCT Pub. Date: Feb. 18, 1999

(30) Foreign Application Priority Data

Aug. 8, 1997 (DK) ..... 0913/97

(51) Int. Cl.[7] ..... B65D 45/32
(52) U.S. Cl. ..... 220/319; 220/320
(58) Field of Search ..... 220/320, 319, 220/315

(56) References Cited

U.S. PATENT DOCUMENTS

| | | | | |
|---|---|---|---|---|
| 1,062,532 | * | 5/1913 | Blair . | |
| 1,738,951 | * | 12/1929 | Hulbert . | |
| 1,767,217 | * | 6/1930 | Kraft . | |
| 2,412,603 | * | 12/1946 | Dauphinais . | |
| 3,032,229 | * | 5/1962 | Sohoepe et al. . | |
| 3,532,244 | | 10/1970 | Yates . | |
| 3,616,955 | | 11/1971 | Owens-Illinois . | |
| 3,926,333 | * | 12/1975 | Eaton, Jr. et al. | 220/320 |
| 4,712,708 | * | 12/1987 | Taguchi | 220/319 |
| 4,732,294 | * | 3/1988 | Bohler et al. | 220/320 |

FOREIGN PATENT DOCUMENTS

| | | | | |
|---|---|---|---|---|
| 192728 | * | 8/1937 | (CH) | 220/319 |
| 505088 | * | 8/1930 | (DE) | 220/319 |
| 2244479 | | 12/1991 | (GB) . | |

* cited by examiner

*Primary Examiner*—Stephen Castellano
(74) *Attorney, Agent, or Firm*—Kilpatrick Stockton LLP

(57) ABSTRACT

Closure for containers, comprising a locking ring (1) which in situ surrounds the container along the whole of its outer periphery. At least one area of the container closure comprises means which allow a substantially reversible increase in the circumference of the locking ring. The container closure also comprises at least one lock-release part (2) on the radially external side of the locking ring, and which in at least one end is fastened to or constitutes an integrated part of the locking ring (1), and which under the influence of a force results in an increase in the circumference of the locking ring (1). There is hereby provided a closure system for containers whereby the container can be opened even by very weak hands, and whereby it is subsequently possible to effect a closing of the container so that this is closed tightly. The opening and the closing are effected without the use of tools.

15 Claims, 4 Drawing Sheets

CLOSURE FOR CONTAINERS AND USE OF THE CLOSURE

Figure 1:
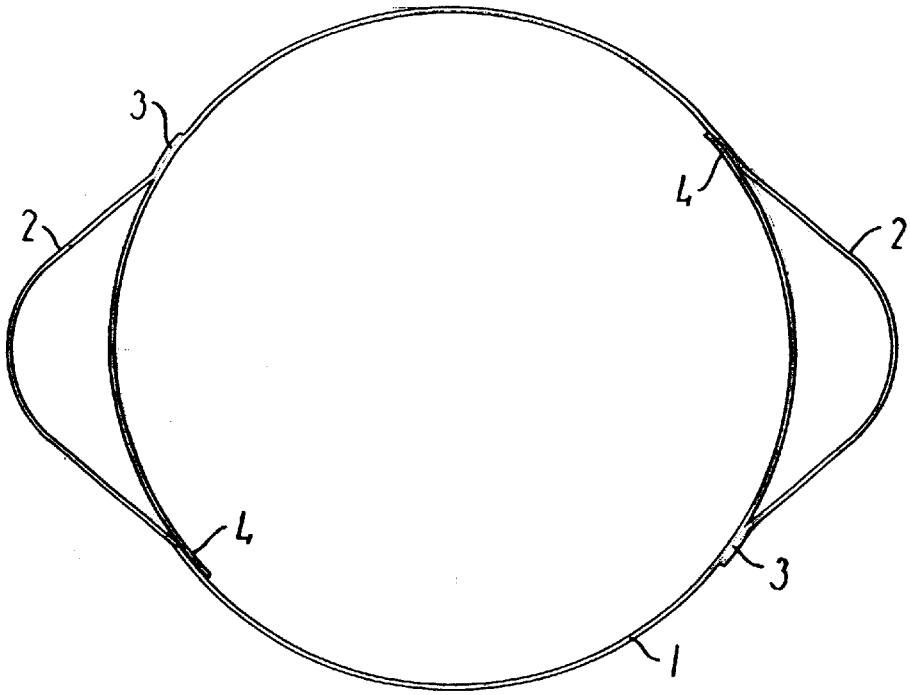

The invention concerns a closure for containers comprising a locking ring which in situ surrounds the container along the whole of its outer periphery, at least one area of said container closure comprising means which allow a substantially reversible increase in the circumference of the locking ring.

With existing systems, the opening and closing of containers of various kinds gives rise to great difficulties, especially for the elderly and handi-capped, in that they do not have the finger strength necessary to open a tightly closed container, nor are they able to close the container tightly and in a proper manner after use. Investigations have thus shown that between 80 and 100% of elderly and handicapped have difficulties in opening everyday containers, e.g. such as conserve glasses with screw tops and the like. Where the rest of the population are concerned, it has shown that about 50% of these experience the same problems.

From Danish patent application no. 5474/89, a locking system is known in the form of a partly surrounding locking ring with an integrated eye part. This eye part can be tightened or loosened as required by means of a handtool, whereby the locking ring loosens or tightens its grip around the container. However, in the first place the system requires the use of a handtool, and secondly it is not an automatically reversible system from the point of view of activation, which means that the plastic deformation which takes place in the course of time may give rise to a break around the eye part.

From the same publication, there is also known a lid system comprising the lid itself, which at its periphery is shaped to receive a locking part. The locking part thus constitutes an accessory for the lid, which is configured to be able to receive the locking part.

In order to be able to manipulate the locking part, the use of a tool is required. Moreover, good precision is required between the individual parts.

A closing system is also known from U.S. Pat. No. 1,326,885, this consisting of a wire and tongues which are in engagement with the container, and where the wire can be activated with the fingers to change its encirculation around the container, so that the tongues lose their engagement in the recesses which are formed in the container for said engagement. In the first place this system requires the use of considerable finger strength, and secondly the system can not be used for all forms of containers, in that it is required that the container is provided with recesses which correspond to the positioning of the tongues. Moreover, great precision is required between the individual parts in order for the container to be tightly closed.

It is the object of the invention to provide a closure system for containers which is not encumbered with the disadvantages of the existing systems, and where the container can be opened even by persons with very weak hands, and whereby it is possible to effect a subsequent closing of the container so that this is closed tightly. The handling takes place without the use of any kind of tool.

This object is achieved with a closure for containers of the kind described in the introduction, and where the container closure also comprises at least one lock-release part on the radially external side of the locking ring, and which in at least one end part is fastened to or constitutes an integrated part of the locking ring, and which under the influence of a force results in an increase in the circumference of the locking ring.

The resilient locking ring gives rise to a tight closing around the container and for the whole of its circumference. When the closure is desired to be removed, this is effected by pressing with a finger on the projecting lock-release part, whereby the locking ring is deformed locally and slightly opened, in that the locking ring increases its circumference, whereby the underpressure is equalized. The lid can now be removed from the container without the use of tools of any kind. When the closure is to be mounted again, this is effected by pressing the locking ring, which is resilient, down over the container and which thus closes tightly again. The closure can be used not only for foils which are desired to lie tightly up against a container and thus form a lid, but is also suitable in forming an integrated part of an actual lid made of a plastic material, and is thus moulded into the lid.

By configuring the container closure according to claim 2, the possibility is provided of increasing the circumference of the locking ring. By discontinuous is meant that the locking ring has an area in which it is not joined.

By configuring the container closure according to the invention and as disclosed in claims 3 and 4, an expedient way is achieved of creating the locking ring's flexibility, in that as disclosed in claim 4, a pressure on the lock-release part results in a change in the dimension of the locking ring, while at the same time the locking ring with its change in dimension continues to surround the whole of the closing part.

By configuring the container closure according to the invention as disclosed in claim 5, an expedient way is achieved of increasing the tension and thus of obtaining a tighter closing and firmer grip around the periphery of the container.

By configuring the container closure according to the invention as disclosed in claims 6 and 7, a function-friendly configuration of the lock-release part is achieved.

By configuring the container closure according to the invention as disclosed in claim 8, an effective counter-pressure is provided when the lock-release part is activated by pressure inwards against the container, in that there is hereby effected a controlled movement of the resilient locking ring.

By configuring the container closure according to the invention as disclosed in claim 9, it is achieved that no uncontrolled displacement of the locking ring takes place when the container is exposed to an overpressure. On the contrary, the pressure will seek equalization in the areas in which the bulge is situated.

By configuring the container closure as disclosed in claim 10, a tight and quite definite positioning of the locking ring is achieved.

By configuring the container closure as disclosed in claim 11, an inexpensive and simple way of forming the container enclosure is achieved, in that round wire results in greater geometric freedom, e.g. when compared with flat wire, when this is closed and formed.

By configuring the container closure as disclosed in claim 12, a tight closing of the container is achieved. This tight closing could, for example, also be achieved by incorporating a spiral spring in the ring.

By configuring the container closure according to the invention as disclosed in claim 13, the possibility is provided of using the system also with containers which require a strong pre-stressing of the locking ring in order to obtain a tight closure, since the lid can thus be taken off by activating the lock-release part via the beam, in that use is made of the beam's tightening arrangement. The beam, which grips around the lock-release parts, presses these against each other, after which the underpressure in the container is equalized and the lid, either in the form of a proper lid or a piece of foil which is laid over, can be removed.

By configuring the container closure according to the invention as disclosed in claims 14 and 15, the lid thus achieved is one which not only closes tightly, but which can also be easily loosened again.

The invention is especially applicable in connection with the moulding of the closure into plastic material in providing a lid with integrated opening/closing system, such as disclosed in claim 16.

Figure 2:
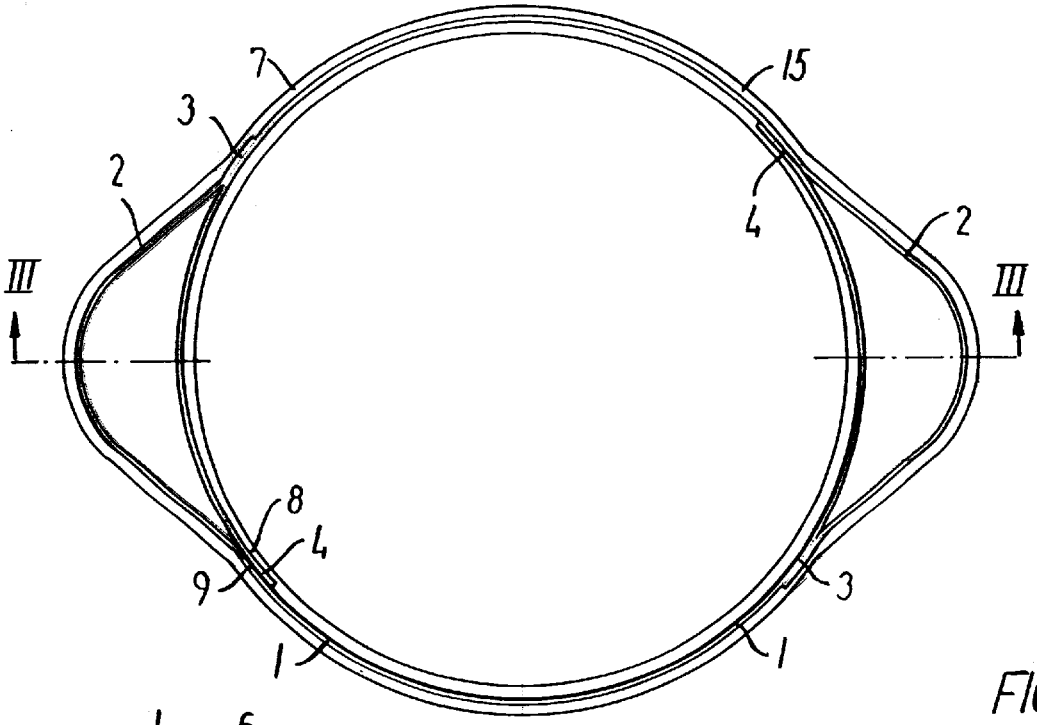
Figure 3:
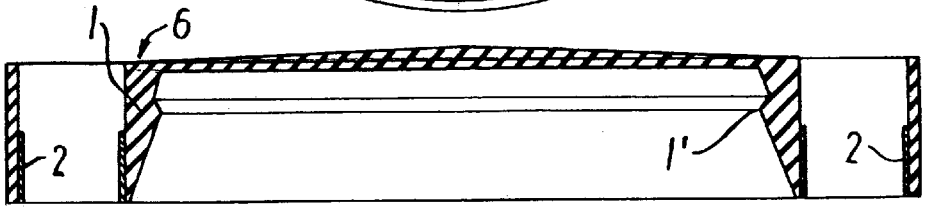
Figure 4:
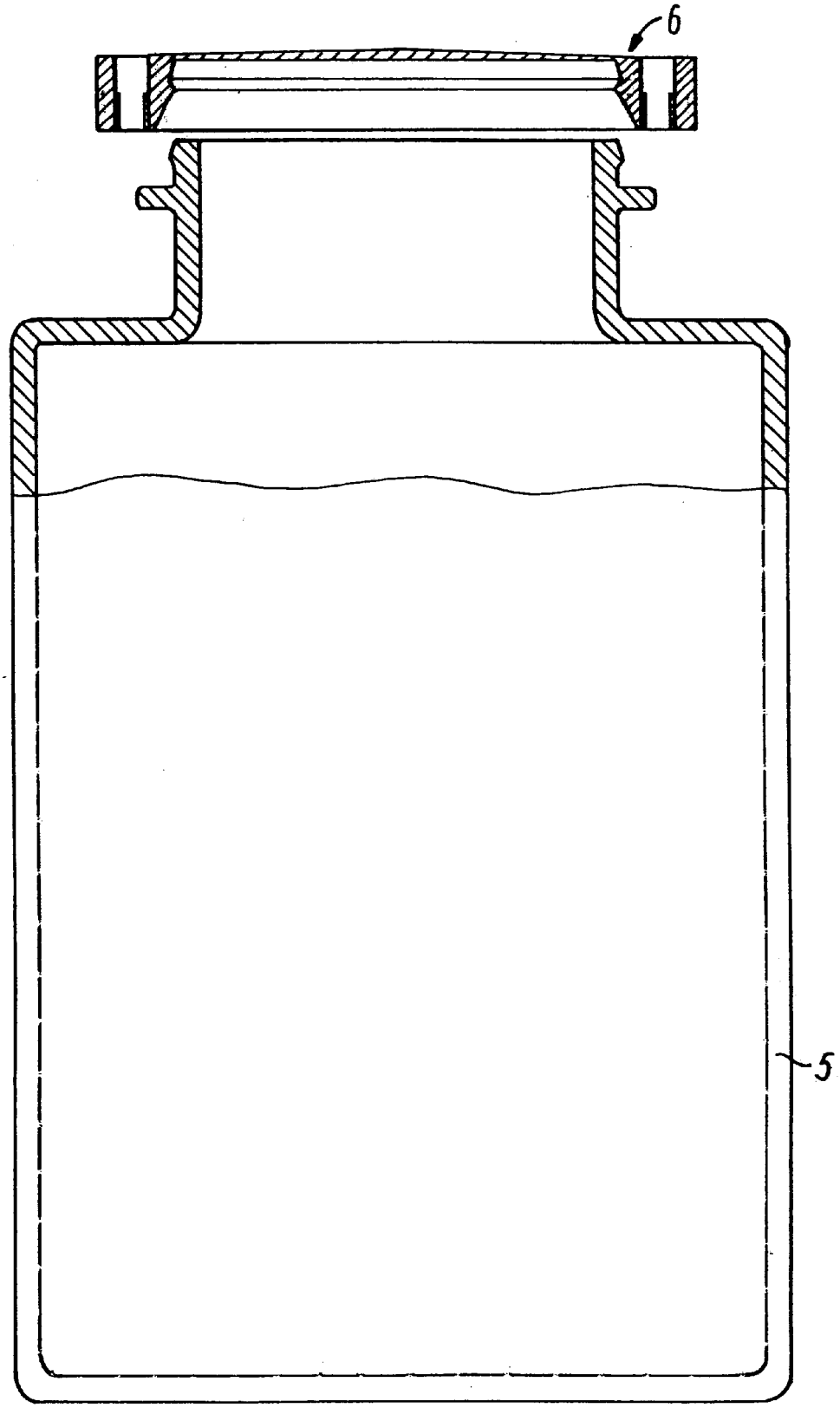
Figure 5A:
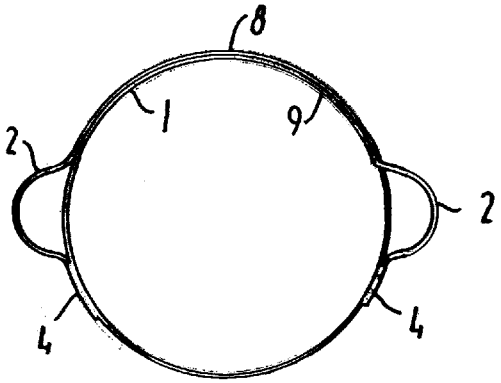
Figure 5B:
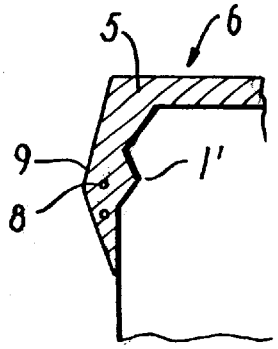
Figure 6:
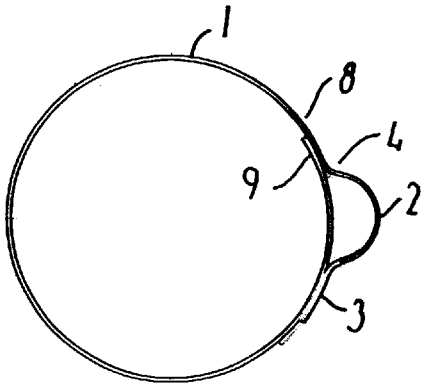
Figure 7:
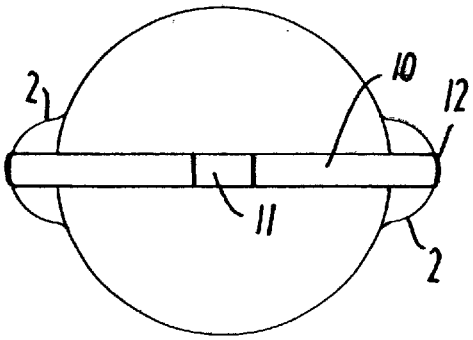
Figure 8:
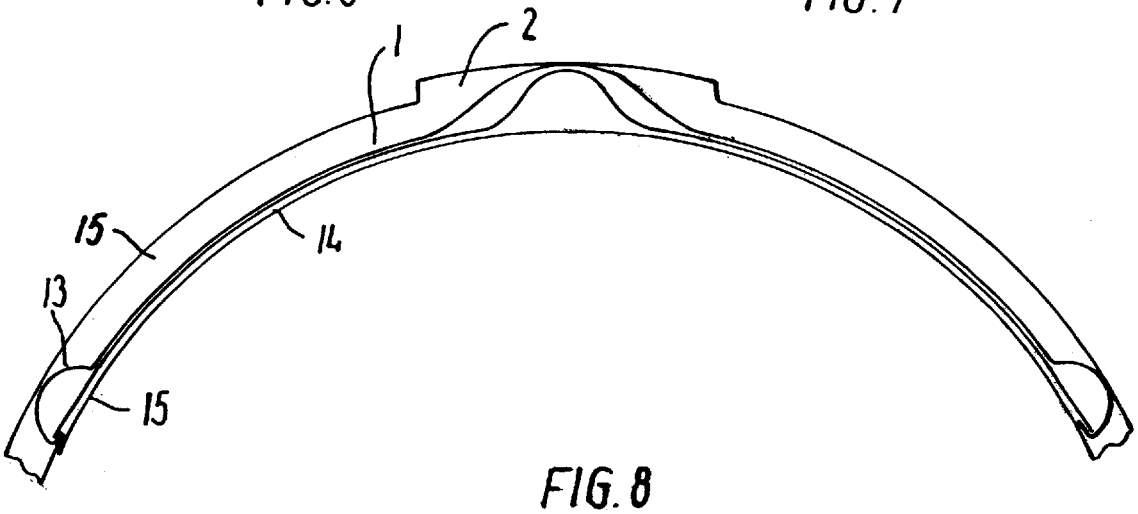
Figure 9:
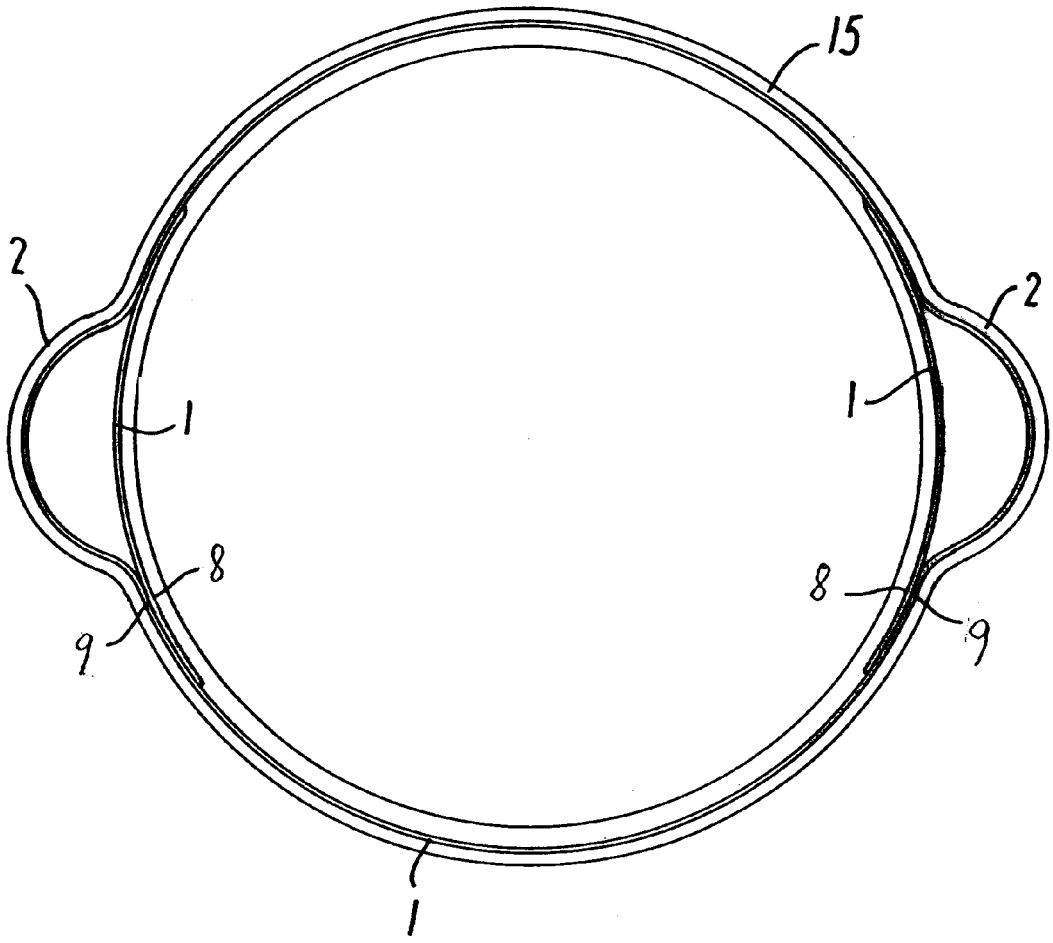

The invention will now be described in more detail with reference to the drawing, where FIG. 1 shows the container closure seen from above, FIG. 2 shows the container closure seen from above and moulded into plastic in the providing of a lid, FIG. 3 shows a section along the line III—III in FIG. 2, FIG. 4 shows a container with a closure of the kind shown in FIG. 3, FIG. 5*a* shows a second example embodiment of the container closure and seen from above, FIG. 5*b* shows a part section of the container closure shown in FIG. 5*a* moulded into plastic, FIG. 6 shows a third example embodiment of the container closure and seen from above, FIG. 7 shows a lid seen from above and provided with a help arrangement in the form of a band, FIG. 8 shows the container closure with a double ring and bulge incorporated and seen from above, and FIG. 9 shows a fourth example embodiment of the container closure and seen from above.

FIGS. 1 and 2 show an example of a container closure comprising a locking ring 1 which is circular and resilient, and a lock-release part 2 which is configured as ears or tongues and, in this case, comprises two of these which are placed opposite each other in extension of the locking ring 1 it-self. The lock-release part 2 is at the one end either fastened to one part of the locking ring at a connection point 3, or constitutes an integrated part of said locking ring, and at the other end constitutes the one continuous part of the locking ring 1, but where the locking ring in the area under the lock-release part 2 continues in an arc, and in the area where the lock-release part 2 extends over into the locking ring 1 has a sliding abutment 4 against the internal side of the locking ring. The locking ring is thus double in an area 4, which parts are displaceable in relation to each other. It is hereby achieved that there where the ears in the form of the lock-release part 2 are pressed against each other, a sliding displacement occurs in the area 4, in that in this area the locking ring 1 has an inner first ring part 8 and a second ring part 9 which can be displaced in relation to each other, and where the first ring part 8 lies inside under the second ring part 9. The locking ring is configured primarily as a circular ring of flat steel, and the lock-release part 2 is also made of flat steel. The locking ring and the lock-release part can also be configured in round wire, and where the demands with regard to the geometry are less, in that round wire provides greater geometric freedom when being formed. On the other hand, flat steel has a more definite contact surface. Finally, the container closure can be made of a resilient plastic.

The container closure can be produced by bending two bands to form ¾ of a circle, and where the one end of each ¾ circle is bent out to form an ear. The two ¾ circles are assembled to form a whole circle, and in such a manner that the ear part of the one ¾ circle lies outside the other ¾ circle's band part under the bent ear. The free end of the closed ear is welded to the underlying locking ring 1.

FIG. 2 shows the container closure according to FIG. 1, where this is partly moulded into plastic 15 to provide a lid, and where this plastic surrounds both the locking ring 1, except in the ear region, where the external side of the locking ring 1 is exposed, and also the lock-release part 2, which is similarly without plastic coating on that surface which faces towards the locking ring 1. Opposite the locking ring 1 there is formed a closing ring 1' in the shape of an annular edge projection, which thus provides a better fastening around the container. This is shown in FIG. 3, where it will be seen that the plastic mass 15 surrounds both the locking ring 1 and the lock-release part 2. The locking ring 1 is placed opposite or below the closing ring 1', and where the plastic which surrounds the locking ring 1 decreases in thickness towards the closing periphery.

Between the plastic material of the ear part 2 and the plastic material surrounding the locking ring 1, a small plastic bridge of approx. 2–3×1–2 $mm^2$ can be moulded, and which can be broken by pressure on the ear part.

A suitable plastic is e.g. polypropylene and polyethylene. It is important that the parts retain their elastic deformation characteristics, and the plastic especially along the inner periphery of the locking ring must be flexible.

FIG. 4 shows the lid 6 shown in FIGS. 2 and 3, where this is to be placed on a container 5 in the form of a bottle.

The locking ring is typically produced in band steel with a dimension of 0.3×6.0 mm, and where the ear's projection depends on the shape of the container, but in connection with an outside diameter on a jar of around 80 mm, an ear projection of 10 mm will be suitable. The locking ring is prestressed so that its pre-stressed force is in the order of 15–20 Newton. After mounting of the closure on a container, the locking ring 1 has a tension typically in the order of 150–500 MPa, depending on the selected thickness and breadth of the locking ring. With the above values, the pressure which is necessary to remove the lid lies in the order of 5–7 Newton, which is a level that is quite acceptable for weak hands.

Instead of pre-stressing the locking ring, this could possibly have a spiral spring incorporated for the creation of the tension. It could also be envisaged that the locking ring itself could completely constitute an annular spring on which the lock-relase part 2 could be mounted as mentioned above, possibly with both of its ends for each ear in an immovable connection with the locking ring, so that forces applied to the ears will be conducted over into the locking ring, which will be deformed or changed in dimension.

By producing a lid which consists of both metal and plastic, the lid thus produced is one which is also suitable for autoclavation, and which in accordance with the invention can otherwise be opened and closed again and again and still close tightly. Since the metal itself is totally embedded in the plastic, the resulting product is thus heat-resistant and hygienic.

FIG. 5*a* shows a second example embodiment of the container closure according to the invention, this being configured in round wire which can thus be bent out in one part, in that the round wire in certain zones makes it possible for both a first ring part 8 and a second ring part 9 to be laid over each other, which will also be seen indicated in FIG. 5*b*. Also here the container closure consists of a locking ring 1 and two lock-release parts 2 lying opposite each other, the one end 3 of which constitutes an integrated part of locking ring 1, and which at the other end 4 can describe relative movements in relation to the locking ring 1. This is a consequence of the locking ring 1 comprising an overlap part 7, where a first ring part 8 and a second ring part 9 can move in relation to each other when the lock-release parts 2 are pressed towards each other. The lock-release parts 2 thus provide/transfer some extra material for use as the actual locking ring, so that this is loosened around the container, in that it is deformed and changed in dimension by the handling described.

FIG. 6 shows a third example embodiment of a container closure, where said container closure comprises only a single lock-release part 2, which in relation to the locking ring 1—as earlier discussed—has one end part 3 which is immovable in relation to the locking ring 1, and a second end part 4 lying tightly up against the locking ring 1, and which can describe relative movements in relation to the underlying part 9 of said locking ring.

When the lock-release part 2 is pressed in towards the container, material is transferred from this part to the actual locking ring 1, which thus increases in circumference, whereby the difference in pressure is equalized and the lid can more easily be removed.

FIG. 9 shows a fourth example embodiment of a container closure, this consisting of a locking ring 1 which is divided into three sections, in that the locking ring is circular in shape, but opposite the areas where the lock-release part 2 is placed it has its locking ring consisting of a lid band part which at the one end is disconnected from the remainder of the locking ring, so that in this area there is a break in the locking ring opposite each ear. This band parts can either have a sliding abutment against the remainder of the locking ring, such as earlier described, or by means of recesses can be engaged in groove parts in the rest of the locking ring and thus have a definite and yet sliding abutment. The locking ring thus comprises three parts, and where two parts are short, band-formed, partly circular bands, while the rest of the locking ring extends over into the lock-release part 2 and is thus a continuous band.

FIG. 7 shows a lid which is applicable for use on larger containers which require greater closing forces and thus also greater opening forces. In order to make the opening of the container easier, a help arrangement in the form of a transverse beam/crossbar 10 is provided, this being fastened to the two lock-release parts 2 which lie opposite each other in an area 12. When it is desired to activate the lock-release parts, use is made of a clamping arrangement 11 which is provided on the beam/crossbar 10. This clamping arrangement can, for example, be in the form of an arrangement which is known from patent openers, for example on soft-drink bottles. When this clamping arrangement is tightened, this results in a pressing-together of the crossbar 10, whereby the ears are pressed in towards each other. The underpressure in the container will thus be equalized, and since the locking ring 1 now also has a greater diameter as a consequence of the displacement of the lock-release parts and thus gives rise to an extension of the locking ring, this can easily be removed without effort.

FIG. 8 shows the container closure with a double ring 14 and a bulge 13 incorporated, and seen from above in section, and where the locking ring 1 thus has the bulge 13 incorporated, in that said bulge will be deformed by an overpressure in the container, and where the underlying double ring 14, which is in abutment with a recess in the bulge 13 itself, ensures that the container continues to remain tightly closed despite the pressure in the container.

The working mechanism behind the invention will now be discussed in more detail with the help of an example calculation:

Calculation Example

The concrete material data and dimensions which are used as starting point are as follows:

Steel springs: Geometry as in FIG. 2, breadth 6 mm and thickness 0.3 mm. The material is spring steel with E-module 2, 1E5 MPa, and an assumed minimum elastic limit of 1000 MPa.

Plastic jacket: The material is soft plastic with E-module 20 MPa.

Glass+lid: In the calculations, these are considered to be stiff. The lid is envisaged to be made of metal with E-module greater than 1E4 MPa, possibly with built-in "click function".

Discussion of the Working Mode

When the steel spring is stressed by a grip of 1 mm on the diameter, i.e. the spring is stressed by being pressed in over a diameter which is 1 mm greater then the inside diameter of the spring in its slack condition, the overall radial force on the whole circumference becomes approx. 23 N.

The spring tension arises due to the bending effect of the two ears. The stiffness with bending effect is proportional to the bending moment of inertia, which can be derived from: $Iz=\frac{1}{12}\, b\, t^3$ for a spring cross-section, where b is the breadth and t is the thickness.

If the thickness is increased to e.g. 0.4 mm, the overall radial spring force can therefore be calculated relatively by: $Fs=23\text{ N }(=0.4/0.3)^3=54.5\text{ N}$.

On the other hand, if the breadth is changed the effect hereof is linear. E.g. if the breadth is changed from 6 mm to 3 mm, the overall radial spring force becomes: $Fs=23\text{ N }(3/6)=11.5\text{ N}$.

If the radial force is desired to be held constant, and the thickness changed to 0.4 mm, this can be achieved by reducing the breadth to 2.5 mm at the same time, in that: $Fs=23\text{ N }(0.4/0.3)3(^{2.5}/_{6})=23\text{ N}$.

With a breadth of 6 mm and a thickness of 0.3 mm, the calculations show that the induced bending stresses (which must not exceed the elastic limit of approx. 1000 MPa) become approx. 154 MPa.

For a bend-influenced construction such as this, the bending stress is calculated as the bending moment Mb divided by the moment of resistance Wz, which depends on the square of the material thickness.

If the thickness is increased from 0.3 mm to 0.4 mm, the induced bending stress can thus be calculated relatively by: $ob=154\text{ MPa }(0.4/0.3)^2=274\text{ MPa}$.

Both the induced bending forces and the induced stresses are directly proportional to the applied grip, i.e. a grip of 0.5 mm reduces both the radial force and the maximum tension by half.

It should be noted that the distribution of pressure along the periphery from the spring is particularly uneven when this presses on a hard edge. This is equalized by the plastic jacket when the container closure is moulded into such a jacket.

The geometry of the plastic jacket is configured with the view to minimizing annular tensions, and to providing a far more constant radial distribution of pressure between the jacket and side walls.

The selected elasticity module of approx. 20 MPa is considered to be a suitable compromise. With an applied grip of 1 mm on the diameter of the steel spring, according to the calculations the overall radial force between jacket and glass wall becomes 19.1 N. If the E-module for the plastic jacket is increased to 40 MPa, the force becomes 24.4 N, but at the same time the pressure distribution becomes far more uneven. If the E-module is increased further, the pressure distribution is greatly worsened while the force is only very slightly increased. Conversely, smaller E-modules give an even pressure distribution while at the same time the force is reduced. For example, with an E-module of 10 MPa, the force becomes 13.5 N. With the geometry selected, E-modules from 8 to 30 MPa are estimated to be usable.

According to the calculations, the closure can be "deflated" by pressing on the 2 ears with a force of merely 5 N. The pressure between the plastic jacket and the glass is eliminated (=untight) 90° displaced from the ears. There will still be a positive pressure opposite the ears. A more even reduction of the pressure along the circumference can be achieved by means of "tracks", but at the same time this reduces the "deflation" effect.

The underpressure in the glass, e.g. due to cooling, will result primarily in the lid being pressed out towards the glass in the axial direction. The force necessary in order to "deflate" the closure will by and large hereby be unchanged, in that the tightening is on the side wall of the glass.

What is claimed is:

1. Closure for containers comprising a locking ring (1) which in situ surrounds the container along the whole of its outer periphery, at least one area of said container closure comprising means which allow a substantially reversible increase in the circumference of the locking ring, said container closure also comprising at least one lock-release part (2) on the radially external side of the locking ring, and which in at least one end part is fastened to or constitutes an integrated part of the locking ring (1), and which under the influence of a force results in an increase in the circumference of the locking ring (1), characterized in that at least the one end (3) of the lock-release part (2) is fastened to the locking ring or constitutes an integrated part thereof, and at the other end (4) is relatively displaceable in relation to the underlying part (8) of the locking ring (1).

2. Container closure according to claim 1, characterized in that the means comprise at least one break in the locking ring, so that this has an area in which it is discontinuous.

3. Container closure according to claim 1, characterized in that the means comprise an overlap in at least one area of the locking ring (1) between a first ring part (8) and a second ring part (9) which are displaceable in relation to each other.

4. Container closure according to claim 1, characterized in that the means comprise an elastic spiral spring.

5. Container closure according to claim 1, characterized in that the lock-release part comprises a part formed as ears or tongues.

6. Container closure according to claim 1, characterized in that it, comprises at least two lock-release parts (2) lying opposite each other.

7. Container closure according to claim 1, characterized in that the resilient locking ring (1) extends in a groove.

8. Container closure according to any of the foregoing claims, characterized in that the locking ring (1) comprises at least one bulge (13) and an underlying double ring (14).

9. Container closure according to claim 1, characterized in that this is produced from flat strip.

10. Container closure according to claims 1, characterized in that this is produced from round wire.

11. Container closure according to claim 1, characterized in that the locking ring is prestressed before being placed on the container.

12. Container closure according to claim 6, characterized in that the two oppositely-lying lock-release parts (2) are connected by a transverse crossbar/wire band (10), said crossbar/wire band comprising a clamping arrangement (11).

13. Container closure according to claim 1, characterized in that this is moulded into a plastic material (15) for providing a lid (6) with integrated closing arrangement.

14. Container closure according to claim 13, characterized in that the lid (6) comprises a protruding closing ring, said closing ring (1') being placed opposite or above the locking ring (1).

15. Use of a container closure according to claims 1, and which is embedded in a lid of plastic material.

* * * * *